US007458788B2

(12) United States Patent
Iwano et al.

(10) Patent No.: US 7,458,788 B2
(45) Date of Patent: Dec. 2, 2008

(54) SCROLL FLUID MACHINE INCLUDING BACK-PRESSURE CHAMBER WITH INCREASED PRESSURE RECEIVING AREA

(75) Inventors: Kiminori Iwano, Yokohama (JP); Yuji Komai, Toyko (JP); Kazutaka Suefuji, Kawasaki (JP); Koji Fukui, Machida (JP); Toshitsugu Suzuki, Kunitachi (JP); Junichi Nagasawa, Kamakura (JP); Susumu Sakamoto, Kawasaki (JP); Katsushi Hidano, Yokohama (JP); Kazunari Komatsu, Yokohama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/905,060

(22) Filed: Sep. 27, 2007

(65) Prior Publication Data

US 2008/0101973 A1 May 1, 2008

(30) Foreign Application Priority Data

Oct. 31, 2006 (JP) ..... 2006-296565

(51) Int. Cl.
*F03C 2/00* (2006.01)
*F04C 18/00* (2006.01)

(52) U.S. Cl. ..... 418/55.5; 418/55.3; 418/57

(58) Field of Classification Search ..... 418/60, 418/83, 55.1–55.6, 57, 101; 464/102
See application file for complete search history.

(56) References Cited

U.S. PATENT DOCUMENTS

| | | | | |
|---|---|---|---|---|
| 5,775,888 | A * | 7/1998 | Sakamoto et al. | 418/55.2 |
| 6,190,145 | B1 * | 2/2001 | Fujioka et al. | 418/55.1 |
| 6,592,345 | B2 * | 7/2003 | Suefuji et al. | 418/55.4 |
| 6,716,009 | B2 * | 4/2004 | Sowa et al. | 418/55.5 |

FOREIGN PATENT DOCUMENTS

| | | | | |
|---|---|---|---|---|
| JP | 06213174 | A * | 8/1994 | 418/55.3 |
| JP | 2004-028033 | | 1/2004 | |

* cited by examiner

*Primary Examiner*—Theresa Trieu
(74) *Attorney, Agent, or Firm*—Wenderoth, Lind & Ponack, L.L.P.

(57) ABSTRACT

A scroll fluid machine is capable of readily providing a back-pressure chamber having an increased pressure-receiving area and yet capable of being reduced in size. A fixed scroll member is secured to a casing. An orbiting scroll member is provided at a position facing the fixed scroll member. A holder is provided at the back of the orbiting scroll member, and a coupling member is provided to face the orbiting scroll member across the holder. The coupling member couples together the orbiting scroll member and a driving shaft and performs an orbiting motion together with the orbiting scroll member. A back-pressure plate is provided at the back of the orbiting scroll member, and a back-pressure chamber is formed between the back-pressure plate and the holder.

18 Claims, 7 Drawing Sheets

SCROLL FLUID MACHINE INCLUDING BACK-PRESSURE CHAMBER WITH INCREASED PRESSURE RECEIVING AREA

BACKGROUND OF THE INVENTION

The present invention relates to a scroll fluid machine suitable for use as an air compressor, a vacuum pump, etc.

In general, a scroll fluid machine includes a fixed scroll member and an orbiting scroll member that are disposed to face each other. The fixed and orbiting scroll members each have an end plate and a spiral wrap portion standing on the bottom surface of the end plate. The wrap portions of the two scroll members, which are disposed to face each other, overlap each other to define a plurality of compression chambers therebetween. In this state, the orbiting scroll member is driven to perform an orbiting motion with respect to the fixed scroll member, thereby successively contracting the compression chambers to compress a fluid, e.g. air.

When compressed air is produced, the pressure of compressed air may apply an excessive thrust load to the orbiting scroll member in the direction of the rotating shaft. To minimize the thrust load, a related art proposes a structure in which a back-pressure chamber is provided at the back of the orbiting scroll member so that a part of the compressed air is introduced into the back-pressure chamber, thereby reducing the thrust load by the pressure created in the back-pressure chamber (for example, see Japanese Patent Application Publication No. 2004-28033). In this structure, the orbiting scroll member is coupled through an orbiting bearing to a rotating shaft having a crank portion, and auxiliary cranks are provided between the fixed scroll member and the orbiting scroll member to prevent the orbiting scroll member from rotating around its own axis.

In the above-described related art (Japanese Patent Application Publication No. 2004-28033), the orbiting bearing is provided on the center of the back of the orbiting scroll member. Therefore, the pressure-receiving area of the back-pressure chamber is a doughnut-shape area around the outer periphery of the orbiting bearing. Accordingly, it is unavoidably necessary in order to obtain a sufficiently large pressure-receiving area to increase the size of the orbiting scroll member radially outward by an amount corresponding to the area occupied by the orbiting bearing. Thus, the overall size of the compressor tends to increase.

Further, in the related art, the back-pressure chamber has a doughnut shape in diametrical cross-section because the orbiting bearing is provided on the center of the back of the orbiting scroll member. Therefore, two seal members different from each other in diametrical size are needed to hermetically seal the back-pressure chamber. Consequently, the sealing performance degrades even when only one of the two seal members has become worn. Thus, reliability is likely to decrease.

In addition, in the related art, the bearings of the auxiliary cranks, which constitute a rotation preventing mechanism, are provided between the orbiting scroll member and the fixed scroll member. Therefore, the bearings of the auxiliary cranks need to be disposed radially outward of the wrap portions of the orbiting and fixed scroll members. This causes the compressor to increase in size diametrically.

SUMMARY OF THE INVENTION

The present invention has been made in view of the above-described problems with the related art.

Accordingly, an object of the present invention is to provide a scroll fluid machine capable of readily providing a back-pressure chamber having an increased pressure-receiving area and yet capable of being reduced in size.

The present invention provides a scroll fluid machine including a casing and a fixed scroll member provided to the casing. The fixed scroll member has an end plate and a spiral wrap portion standing on a surface of the end plate. A rotating shaft is supported by the casing and driven to rotate by a drive source. An orbiting scroll member is provided to face the fixed scroll member. The orbiting scroll member has an end plate and a spiral wrap portion standing on a surface of the end plate so as to overlap the wrap portion of the fixed scroll member to define a plurality of compression chambers therebetween. A back-pressure chamber forming member is integrally provided with the casing at the back of the orbiting scroll member to form a back-pressure chamber between itself and the back of the orbiting scroll member. The back-pressure chamber is in communication with the compression chambers. A coupling member is integrally provided with the orbiting scroll member with the back-pressure chamber forming member interposed therebetween. The coupling member is coupled to the rotating shaft through an orbiting bearing. The scroll fluid machine further includes a rotation preventing mechanism that prevents the orbiting scroll member and the coupling member from rotating around their axis.

The orbiting scroll member may have a pressure-receiving member at the back of the end plate of the orbiting scroll member at a distance from the end plate.

The rotation preventing mechanism may be provided between the coupling member and the casing.

A seal member may be provided between the back of the orbiting scroll member and the back-pressure chamber forming member to hermetically seal the back-pressure chamber.

The pressure-receiving member may be provided between the orbiting scroll member and the back-pressure chamber forming member. The back-pressure chamber may be defined between the pressure-receiving member and the back-pressure chamber forming member.

The orbiting scroll member may have an orbiting scroll body and the pressure-receiving member provided at the back of the orbiting scroll body. The orbiting scroll body and the pressure-receiving member may be connected to each other through a connecting member. The connecting member may be provided with a back-pressure inlet bore that communicates between the compression chambers and the back-pressure chamber.

The pressure-receiving member may be provided on the back thereof with a recess circularly recessed over substantially the entire area thereof. A back-pressure plate may be fitted in the recess. The back-pressure chamber may be formed at the back of the back-pressure plate. With this arrangement, the pressure-receiving member can receive the pressure in the back-pressure chamber through the back-pressure plate to press the whole orbiting scroll member toward the fixed scroll member.

The back-pressure chamber forming member may have a mounting tube portion secured at one axial end thereof to an opening end of the casing at one end thereof and a substantially disk-shaped bottom plate portion located at the other axial end of the mounting tube portion to form a bottom surface. The bottom plate portion may be provided with a circular compressed air storing portion recessed rearward of the bottom plate portion and closed at the rear end thereof. The back-pressure chamber may be defined by the compressed air storing portion.

The bottom plate portion of the back-pressure chamber forming member may be provided at an outer peripheral portion thereof with an annular seal fitting groove at a position facing the back-pressure plate, and an annular back-pressure seal member may be fitted in the seal fitting groove. The connecting member may extend through the back-pressure plate and the pressure-receiving member and may be threaded to the back of the orbiting scroll member. The connecting member may have the back-pressure inlet bore axially extending therethrough. The back-pressure inlet bore may open at one end thereof in the back-pressure chamber and communicate at the other end thereof with the compression chambers through a through-hole extending through the end plate of the orbiting scroll member, so that the connecting member introduces compressed air in the compression chambers into the back-pressure chamber.

The coupling member may have a tubular boss portion integrally formed at the center of the back thereof. A crank portion of the rotating shaft may be rotatably fitted in the boss portion through an orbiting bearing.

The rotation preventing mechanism may have a bearing housed in a bearing housing portion of the casing, a bearing housed in a bearing housing portion of the coupling member, and a crank member rotatably supported by the bearings.

DETAILED DESCRIPTION OF THE PREFERRED EMBODIMENTS

Figure 1:
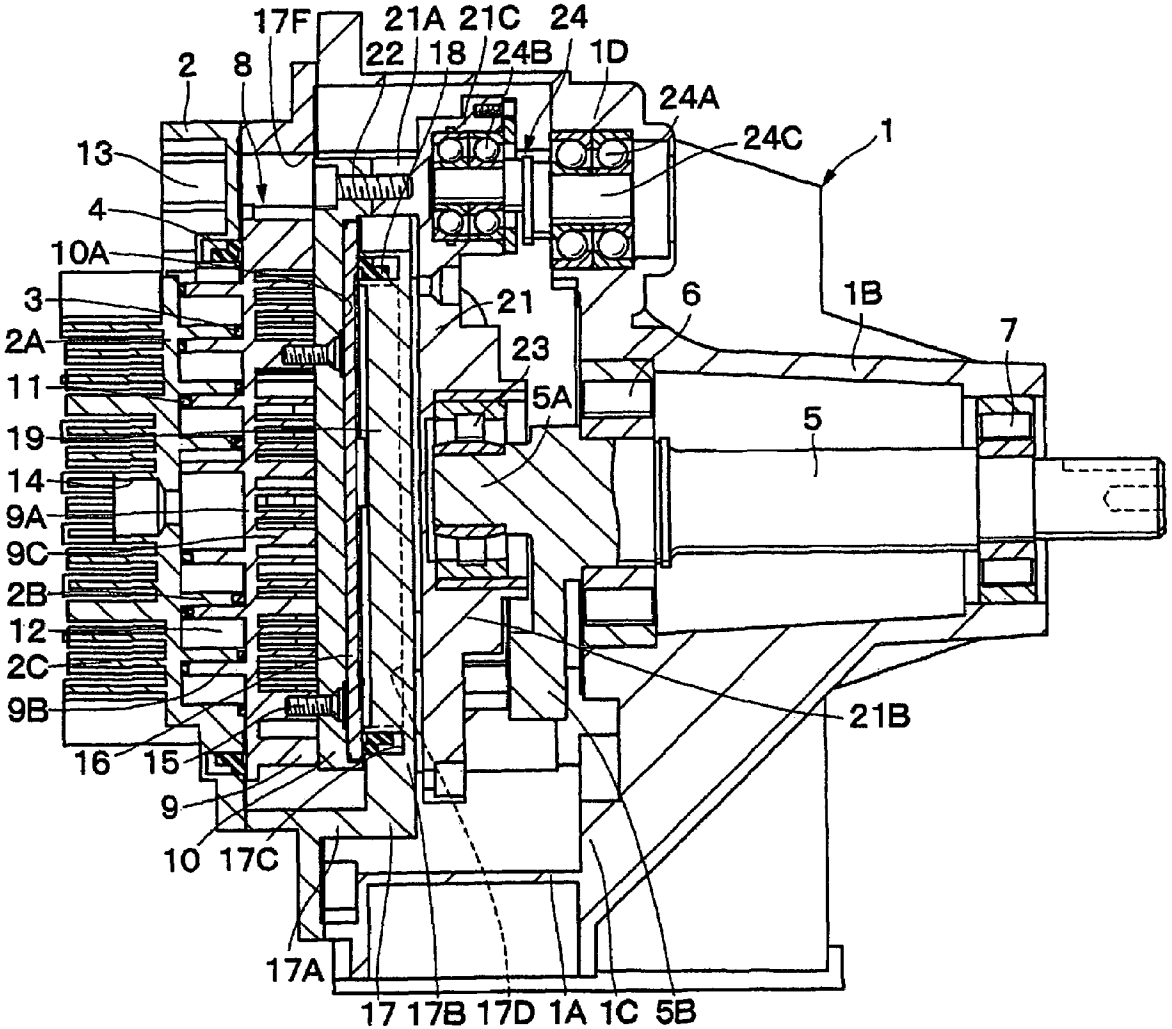
FIG. 1 is a sectional view of a scroll air compressor according to an embodiment of the present invention as seen in the direction of the arrow I-I in FIG. 3.
Figure 2:
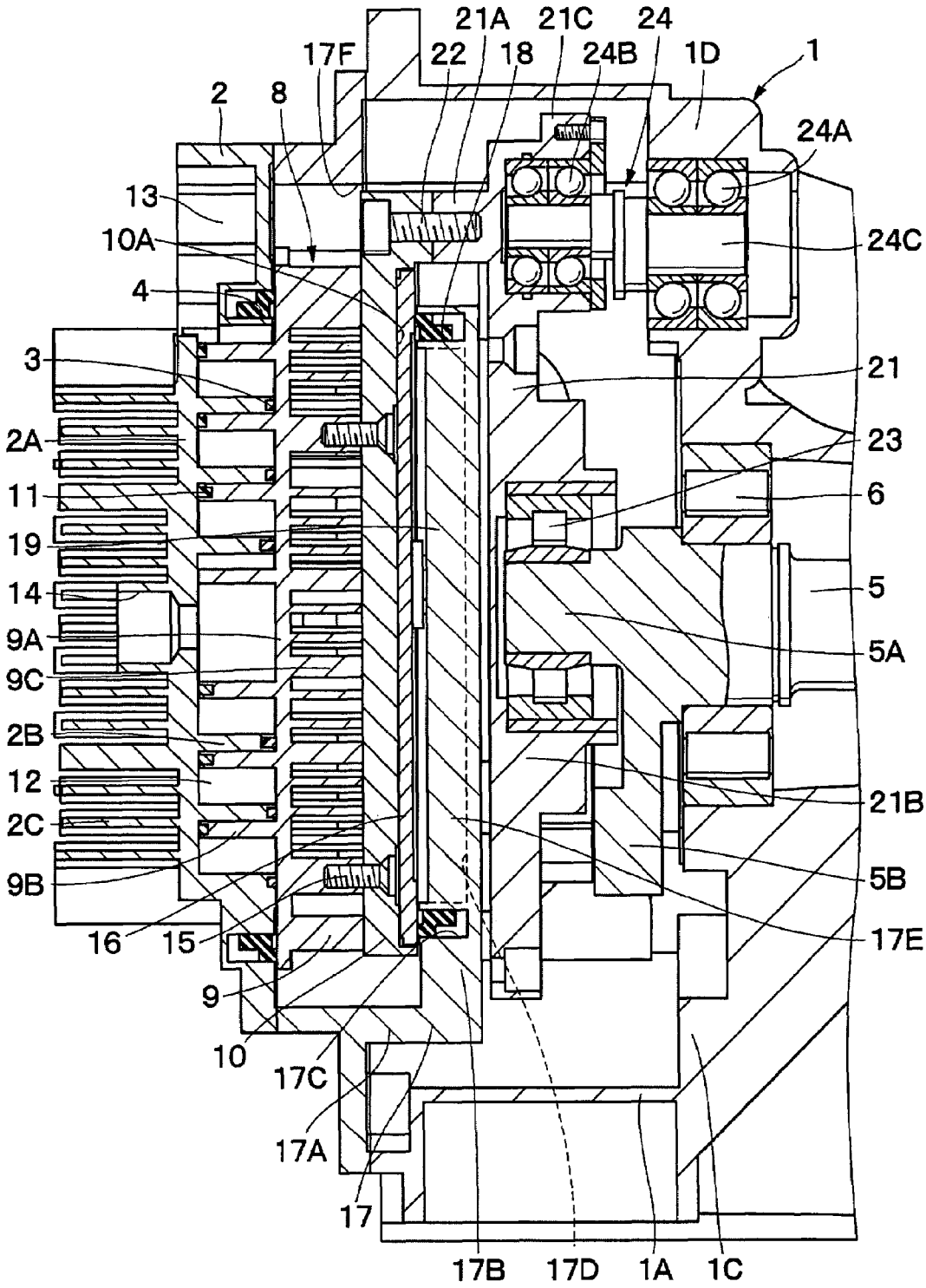
FIG. 2 is an enlarged sectional view of an essential part of the scroll air compressor shown in FIG. 1.
Figure 3:
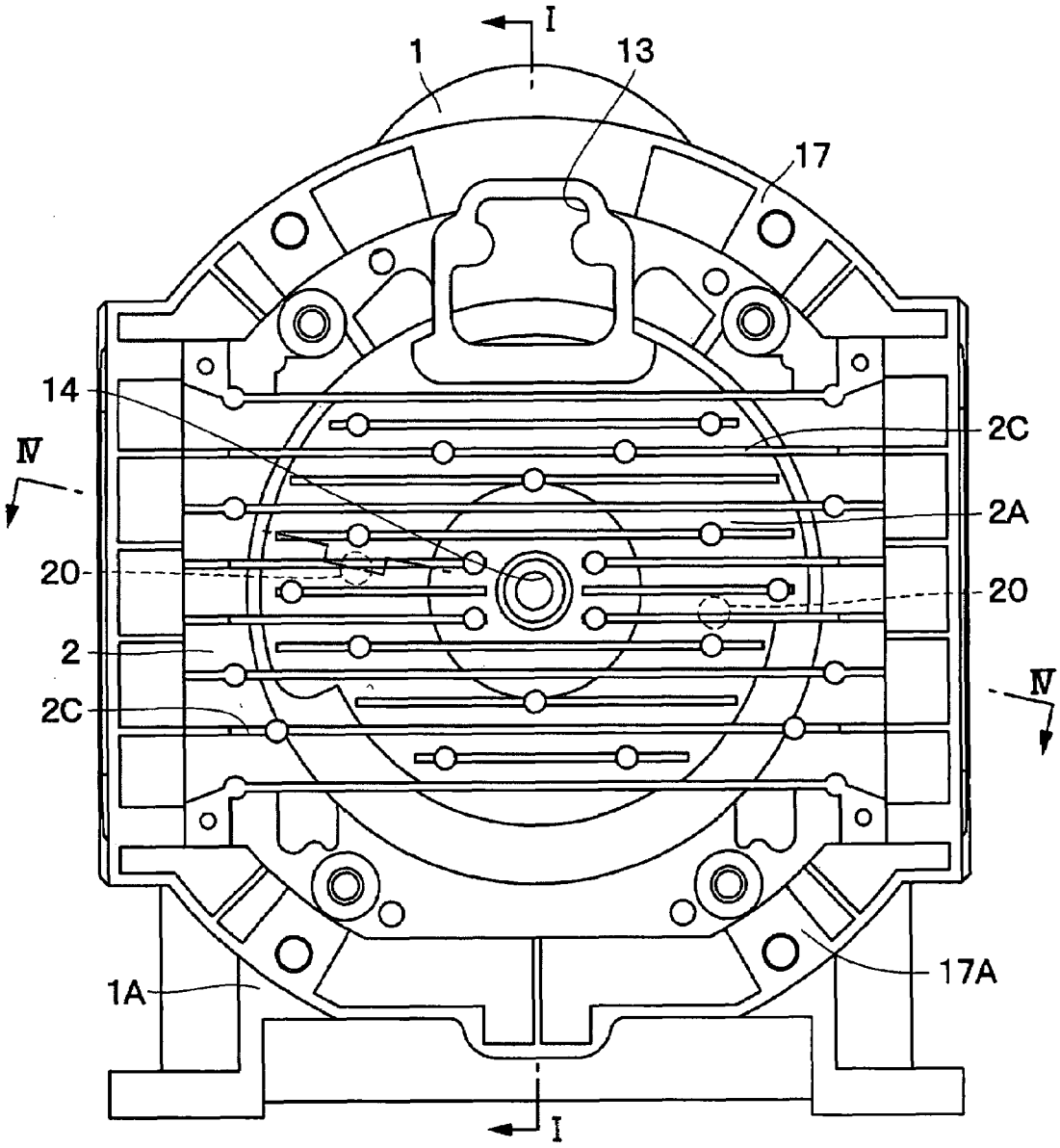
FIG. 3 is a left-hand side view of the scroll air compressor shown in FIG. 1 as seen from the left-hand side thereof.
Figure 4:
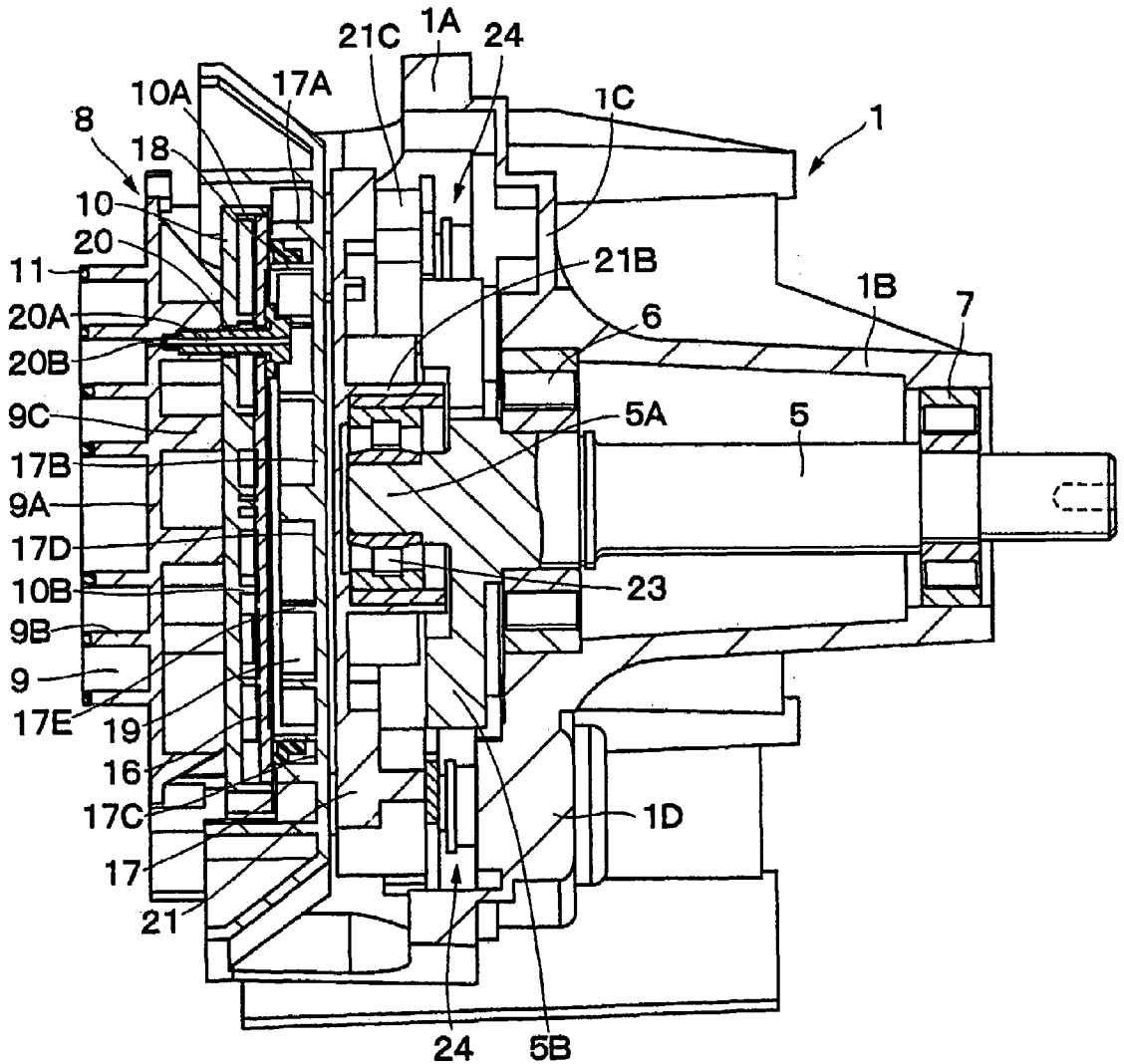
FIG. 4 is a sectional view of the scroll air compressor as seen in the direction of the arrow IV-IV in FIG. 3 in a state where a fixed scroll member is removed therefrom.
Figure 5:
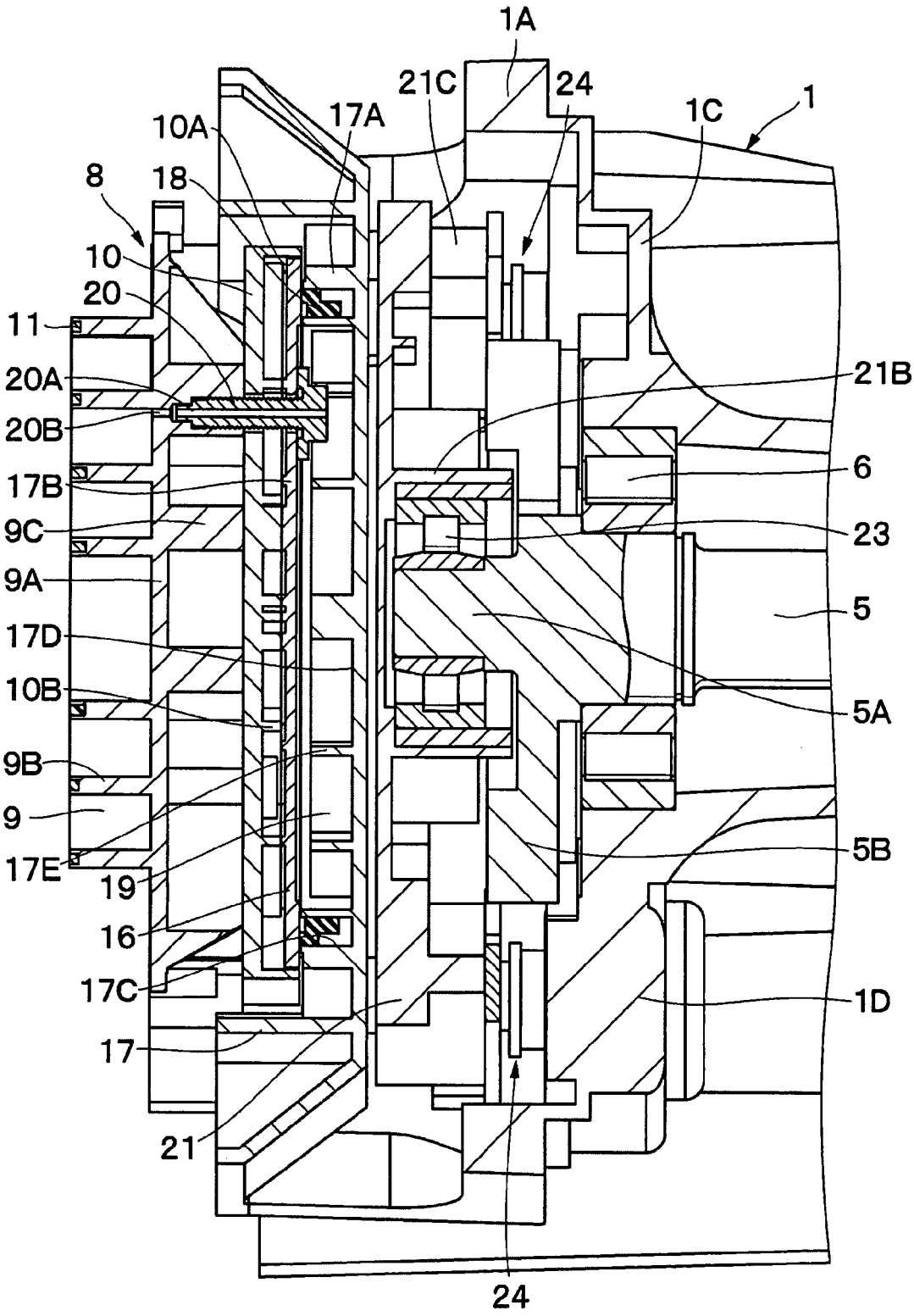
FIG. 5 is an enlarged sectional view of an essential part of the scroll air compressor shown in FIG. 4.
Figure 6:
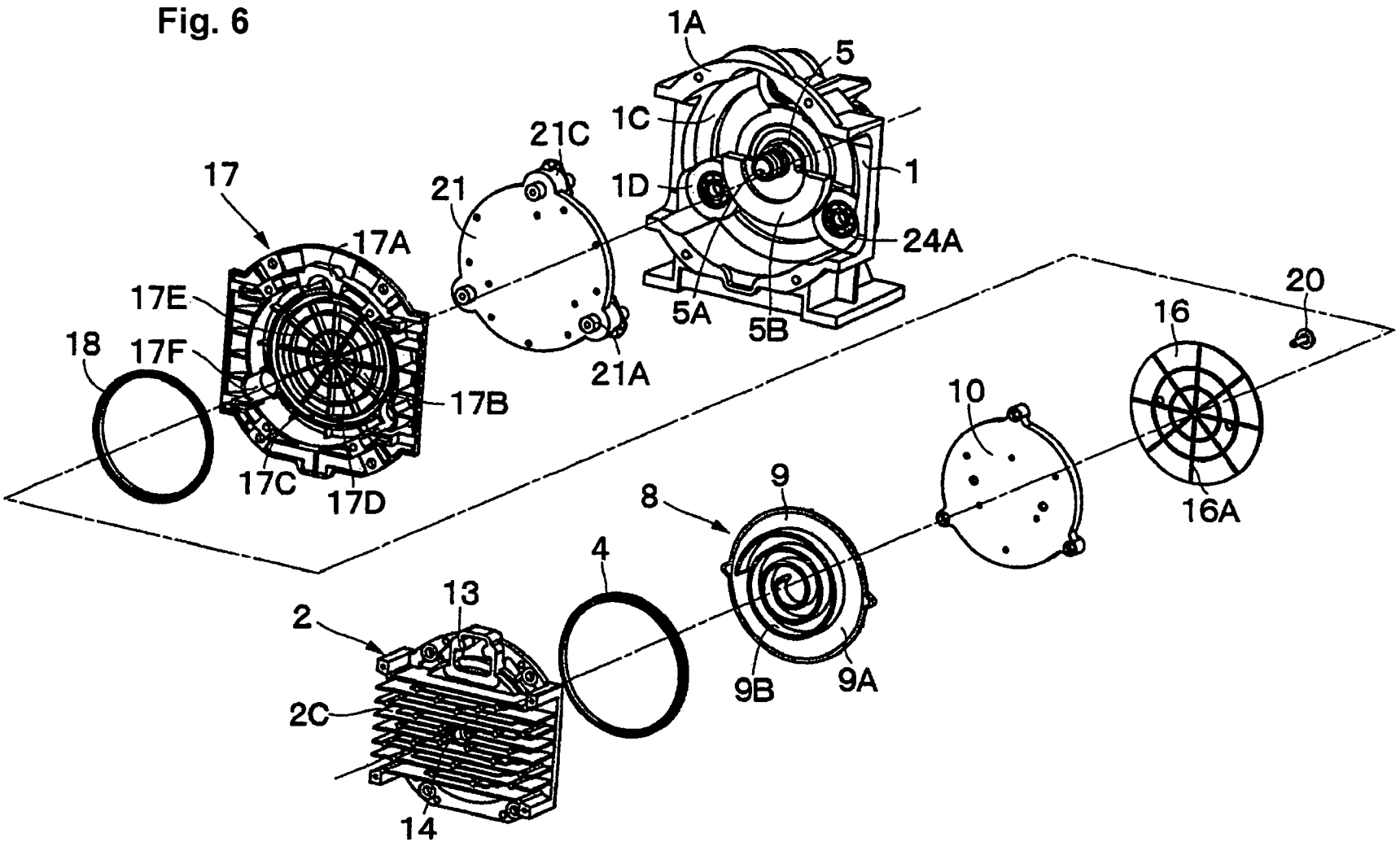
FIG. 6 is an exploded perspective view of the scroll air compressor shown in FIG. 1.
Figure 7:
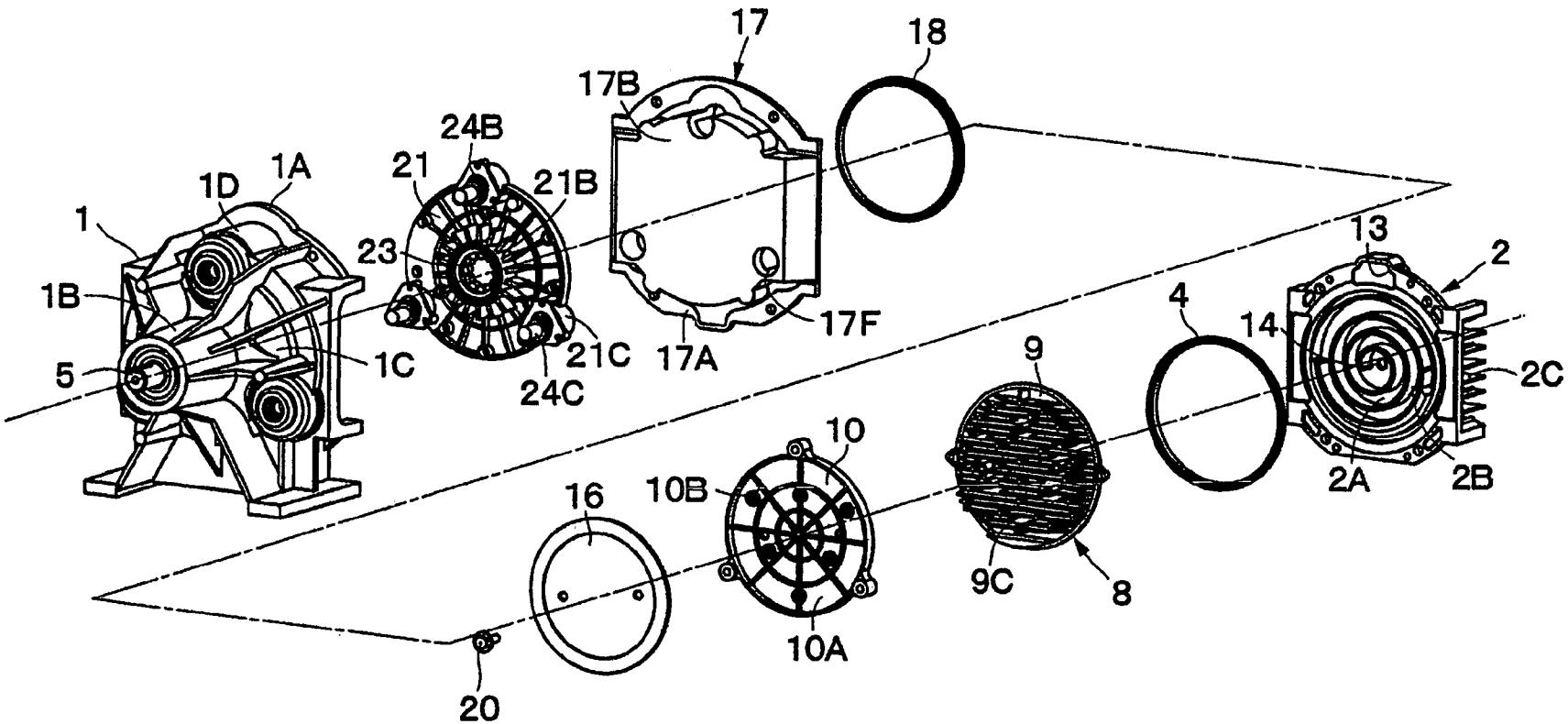
FIG. 7 is an exploded perspective view of the scroll air compressor as seen from a different angle from that in FIG. 6.

A scroll fluid machine according to an embodiment of the present invention will be described below in detail with regard to an air compressor, by way of example, with reference to the accompanying drawings.

In the figures, a tubular casing 1 forms an outer frame of a scroll fluid machine. The casing 1 has a large-diameter tube portion 1A and a bearing tube portion 1B having a smaller diameter than that of the large-diameter tube portion 1A and extending outward from one axial end of the large-diameter tube portion 1A. The casing 1 further has an annular portion 1C formed between the bearing tube portion 1B and the large-diameter tube portion 1A. The annular portion 1C is provided with three (for example) tubular bearing housing portions 1D that accommodate respective bearings 24A of auxiliary crank mechanisms 24 (described later). The bearing housing portions 1D are circumferentially equally spaced from each other.

A fixed scroll member 2 is attached to the casing 1 through a holder 17 (described later). The fixed scroll member 2 is secured to a mounting tube portion 17A of the holder 17 in such a manner as to close the large-diameter tube portion 1A of the casing 1 from the other axial end thereof. Thus, the fixed scroll member 2 is secured to the other end (opening end) of the large-diameter tube portion 1A with the holder 17 interposed therebetween. The fixed scroll member 2 substantially comprises a disk-shaped end plate 2A and a spiral wrap portion 2B provided on the surface of the end plate 2A such that the center of the wrap portion 2B is a spiral starting end and the outer peripheral end of the wrap portion 2B is a spiral terminating end.

A tip seal 3 is provided on the tip of the wrap portion 2B to seal between the wrap portion 2B and an end plate 9A of an orbiting scroll member 8 (described later). In addition, an annular seal member 4 is provided on the surface of the end plate 2A of the fixed scroll member 2. The seal member 4 seals between the end plate 2A and the end plate 9A of the orbiting scroll member 8 to prevent leakage of compressed air from compression chambers 12.

The end plate 2A of the fixed scroll member 2 has a plurality of cooling fins 2C formed on the back thereof to extend parallel to each other. With cooling air passed therebetween, the cooling fins 2C cool the end plate 2A of the fixed scroll member 2 and so forth from the back thereof.

A driving shaft 5 is rotatably provided as a rotating shaft in the bearing tube portion 1B of the casing 1 through bearings 6 and 7. The driving shaft 5 has one axial end thereof projecting from the bearing tube portion 1B to the outside of the casing 1. The other axial end (distal end) of the driving shaft 5 forms a crank portion 5A extending into the large-diameter tube portion 1A of the casing 1. The driving shaft 5 has a pulley (not shown) secured to the one axial end thereof and is coupled through the pulley to an electric motor (not shown) serving as a drive source. Thus, the driving shaft 5 is driven to rotate by the electric motor.

The axis of the crank portion 5A is eccentric with respect to the axis of the driving shaft 5 by a predetermined amount of eccentricity. The crank portion 5A is rotatably fitted in a boss portion 21B of a coupling member 21 through an orbiting bearing 23 (described later). The driving shaft 5 is integrally provided with a balance weight 5B to obtain a rotational balance of the driving shaft 5.

The orbiting scroll member 8 is orbitably provided in the large-diameter tube portion 1A of the casing 1 at a position where it faces the fixed scroll member 2. The orbiting scroll member 8 comprises an orbiting scroll body 9 and a joint member 10. The orbiting scroll body 9 faces the fixed scroll member 2 in the axial direction of the casing 1. The joint member 10 is fixedly secured to the back of the orbiting scroll body 9 to serve as a pressure-receiving member.

The orbiting scroll body 9 comprises a substantially disk-shaped end plate 9A and a spiral wrap portion 9B provided on the end plate 9A to project toward the fixed scroll member 2. A tip seal 11 is provided on the tip of the wrap portion 9B to seal between the wrap portion 9B and the end plate 2A of the fixed scroll member 2.

The orbiting scroll member 8 is positioned so that the wrap portion 9B overlaps the wrap portion 2B of the fixed scroll member 2 with an offset angle of 180 degrees, for example. Thus, a plurality of compression chambers 12 are defined between the two wrap portions 2B and 9B from the outer diameter side toward the inner diameter side (center). During the operation of the compressor, air is sucked into the outermost compression chamber 12 from a suction opening 13 provided in an outer peripheral portion of the fixed scroll member 2, and the sucked air is successively compressed in the compression chambers 12. Finally, the compressed air stored in the central compression chamber 12 is discharged to the outside through a discharge opening 14 provided in the center of the fixed scroll member 2.

The end plate 9A of the orbiting scroll body 9 has a plurality of cooling fins 9C formed between the same and the joint member 10. The cooling fins 9C extend parallel to each other in the same direction as the cooling fins 2C of the fixed scroll member 2 to cool the end plate 9A of the orbiting scroll member 8 and so forth with cooling air.

The joint member 10 of the orbiting scroll member 8 is secured to the back of the end plate 9A by using a plurality of bolts 15. The central portion of the back of the joint member 10 is circularly recessed over substantially the entire area thereof to provide a recess 10A. The recess 10A stretches to such an extent that it covers the whole wrap portion 9B, for example. A back-pressure plate 16 (described later) is fitted in the recess 10A. Thus, the joint member 10 receives the pressure in a back-pressure chamber 19 (described later) through the back-pressure plate 16. In addition, the back of the joint member 10 has a web-like rib 10B provided in the recess 10A to extend over substantially the entire area thereof. The rib 10B enhances the strength of the joint member 10.

The back-pressure plate 16, which is attached to the back of the joint member 10, has a disk-like shape with substantially the same size as that of the recess 10A of the joint member 10, and is fitted in the recess 10A of the joint member 10 at a distance from the end plate 9A of the orbiting scroll member 8. The back-pressure plate 16 is in contact with the bottom surface of the recess 10A at the front side thereof. A back-pressure chamber 19 (described later) is formed at the rear side of the back-pressure plate 16. Thus, the back-pressure plate 16 receives the pressure in the back-pressure chamber 19 and presses the whole orbiting scroll member 8 toward the fixed scroll member 2 through the joint member 10. The front (forward) surface of the back-pressure plate 16 is provided with a web-like rib 16A over substantially the entire area thereof to enhance the strength of the back-pressure plate 16.

A holder 17 is secured to the casing 1 at the back of the orbiting scroll member 8 to serve as a back-pressure chamber forming member. The holder 17 is integrally provided with the casing 1. The holder 17 comprises a mounting tube portion 17A secured at one axial end thereof to the opening end of the large-diameter tube portion 1A of the casing 1 and a substantially disk-shaped bottom plate portion 17B located at the other axial end of the mounting tube portion 17A to form a bottom surface. The mounting tube portion 17A is clamped at the outer periphery thereof between the fixed scroll member 2 and the large-diameter tube portion 1A of the casing 1 and houses therein the joint member 10 of the orbiting scroll member 8 and the back-pressure plate 16.

The outer periphery of the bottom plate portion 17B is provided with an annular seal fitting groove 17C at a position facing the back-pressure plate 16. An annular back-pressure seal member 18 is fitted in the seal fitting groove 17C. The center of the bottom plate portion 17B is provided with a circular compressed air storing portion 17D inside the seal fitting groove 17C. The compressed air storing portion 17D is recessed rearward of the bottom plate portion 17B and closed at the rear end thereof. The compressed air storing portion 17D is disposed at a position facing the back-pressure plate 16 and open toward it with a smaller area than that of the back-pressure plate 16. Thus, the holder 17 forms a circular back-pressure chamber 19 located in the compressed air storing portion 17D between itself and the back-pressure plate 16, and the outer periphery of the back-pressure chamber 19 is hermetically sealed with the back-pressure seal member 18.

The bottom plate portion 17B is provided with a web-like rib 17E inside the compressed air storing portion 17D. Thus, the rib 17E enhances the strength of the bottom plate portion 17B.

In addition, the bottom plate portion 17B has a three relief holes 17F axially extending through an outer peripheral portion thereof outside the seal fitting groove 17C. The relief holes 17F are, for example, circumferentially equally spaced from each other, and coupling projections 21A of a coupling member 21 (described later) are inserted through the relief holes 17F, respectively. When the orbiting scroll member 8 performs an orbiting motion together with the coupling member 21, the relief holes 17F prevent the coupling projections 21A, which couple them together, from interfering with the holder 17.

Two (for example) back-pressure inlet pipes 20 are provided as connecting members between the orbiting scroll body 9 and the joint member 10, which constitute the orbiting scroll member 8. Each back-pressure inlet pipe 20 extends through the back-pressure plate 16 and the joint member 10 and is threaded to the back of the orbiting scroll member 8. The back-pressure inlet pipes 20 each have a back-pressure inlet bore 20A axially extending therethrough. The back-pressure inlet bore 20A opens at one end thereof in the back-pressure chamber 19 and communicates at the other end thereof with the compression chambers 12 through a through-hole 20B extending through the end plate 9A of the orbiting scroll member 8. Thus, the back-pressure inlet pipes 20 introduce the compressed air in the compression chambers 12 into the back-pressure chamber 19. In this case, the back-pressure inlet pipes 20 function also as connecting members that firmly connect together the orbiting scroll body 9 and the joint member 10.

It should be noted that simple seals such as O-rings may be provided between the back-pressure inlet pipes 20 and the orbiting scroll body 9, between the back-pressure inlet pipes 20 and the joint member 10, or between the back-pressure inlet pipes 20 and the back-pressure plate 16. If the orbiting scroll body 9, the joint member 10 and the back-pressure plate 16 are integrally molded, through-holes that extend through these members may be provided instead of using the back-pressure inlet pipes 20. A coupling member 21 is provided at one axial end of the orbiting scroll member 8 with the holder 17 interposed therebetween. The coupling member 21 is formed in a substantially disk-like shape and has three coupling projections 21A provided on the front side thereof to project toward the holder 17. The coupling projections 21A are circumferentially equally spaced from each other. The coupling projections 21A are inserted through the relief holes 17F, respectively, of the holder 17 and coupled to the joint member 10 of the orbiting scroll member 8 by using coupling bolts 22. Thus, the coupling member 21 is integrally provided with the orbiting scroll member 8.

The coupling member 21 has a tubular boss portion 21B integrally formed on the center of the back thereof. A crank portion 5A of a driving shaft 5 (described later) is rotatably fitted in the boss portion 21B through an orbiting bearing 23. Thus, the coupling member 21 couples together the orbiting scroll member 8 and the driving shaft 5 with the holder 17 interposed therebetween and performs an orbiting motion together with the orbiting scroll member 8 in response to the rotational motion of the driving shaft 5.

Further, the coupling member 21 has three (for example) tubular bearing housing portions 21C provided on the outer periphery of the back thereof to house respective bearings 24B of auxiliary crank mechanisms 24 (described later). The bearing housing portions 21C are disposed at respective positions facing the bearing housing portions 1D of the casing 1 and positioned at one axial end side of the coupling projections 21A.

The auxiliary crank mechanisms 24 are provided between the coupling member 21 and the casing 1 as rotation preventing mechanisms. The auxiliary crank mechanisms 24 each comprise a bearing 24A housed in one bearing housing portion 1D of the casing 1, a bearing 24B housed in one bearing housing portion 21C of the coupling member 21, and a crank member 24C rotatably supported by the bearings 24A and 24B. The auxiliary crank mechanisms 24 prevent the orbiting scroll member 8 from rotating around its own axis in the casing 1 during the orbiting motion thereof.

The scroll fluid machine according to this embodiment, arranged as described above, operates as follows when used as an air compressor.

First, when the driving shaft 5 is driven to rotate by a drive source such as an electric motor, the rotation of the driving shaft 5 is transmitted to the orbiting scroll member 8 through the orbiting bearing 23. Consequently, the orbiting scroll member 8 orbits about the axis of the driving shaft 5 while being prevented from rotating on its own axis by the auxiliary crank mechanisms 24.

At this time, the compression chambers 12, which are defined between the wrap portion 2B of the fixed scroll member 2 and the wrap portion 9B of the orbiting scroll member 8, are successively contracted from the outer diameter side toward the inner diameter side. Thus, the compressor successively compresses the outside air sucked in from the suction opening 13 in the compression chambers 12 and discharges the compressed air from the discharge opening 14 to an external tank (not shown) or the like.

A part of the air compressed in the compression chambers 12 is introduced into the back-pressure chamber 19 defined at the back of the orbiting scroll member 8 through the back-pressure inlet pipes 20. Consequently, the orbiting scroll member 8 can be pressed toward the fixed scroll member 2 by the pressure in the back-pressure chamber 19 even when the compressed air pressure applies an excessive thrust load to the orbiting scroll member 8 in a direction away from the fixed scroll member 2. Thus, the thrust load can be minimized.

In this embodiment, the orbiting scroll member 8 is coupled to the driving shaft 5 through the coupling member 21 provided to face the orbiting scroll member 8 across the holder 17. Therefore, the orbiting bearing 23 can be provided on the coupling member 21 and need not be provided on the back of the orbiting scroll member 8. Accordingly, the back-pressure chamber 19 provided between the back of the orbiting scroll member 8 and the holder 17 can be designed freely independently of the orbiting bearing 23. Thus, the pressure-receiving area of the back-pressure chamber 19 can be increased easily without increasing the overall configuration of the compressor or the like. In addition, because the back-pressure chamber 19 can be formed into a circular configuration, for example, it can be sealed with a single back-pressure seal member 18. Accordingly, reliability can be improved in comparison to a structure using two seal members as in the related art.

Further, because the back-pressure plate 16 is provided at the back of the end plate 9A of the orbiting scroll member 8 at a distance from the end plate 9A, the cooling fins 9C can be provided between the back-pressure plate 16 and the end plate 9A of the orbiting scroll member 8 and supplied with cooling air. Consequently, even when the orbiting scroll member 8 is heated by compression heat from the compression chambers 12, the orbiting scroll member 8 can be cooled by using cooling air, and hence the compression efficiency can be increased.

In addition, because the auxiliary crank mechanisms 24 are provided between the coupling member 21 and the casing 1, the bearings 24A and 24B of the auxiliary crank mechanisms 24 can be disposed at the axially rear side of the wrap portion 9B of the orbiting scroll member 8. Consequently, the compressor or the like can be reduced in size in the diametrical direction in comparison to a structure in which the rotation preventing mechanism is provided between the orbiting scroll member 8 and the fixed scroll member 2 as in the related art.

In addition, because the back-pressure seal member 18 for hermetically sealing the back-pressure chamber 19 is provided between the back of the orbiting scroll member 8 and the holder 17, the back-pressure chamber 19 can be sealed by using a single back-pressure seal member 18 that surrounds the back-pressure chamber 19.

In addition, the orbiting scroll member 8 comprises the orbiting scroll body 9 and the joint member 10 provided at the back of the orbiting scroll body 9, and the orbiting scroll body 9 and the joint member 10 are connected by the back-pressure inlet pipes 20. Therefore, the orbiting scroll body 9 and the joint member 10 can be firmly connected together by using the back-pressure inlet pipes 20.

Although in the foregoing embodiment the present invention has been described with regard to a scroll air compressor as an example of scroll fluid machines, the present invention is not necessarily limited to the scroll air compressor, but may also be widely applied to other scroll fluid machines, e.g. vacuum pumps, refrigerant compressors, etc.

According to the foregoing embodiment, the orbiting scroll member is coupled to the rotating shaft through the coupling member provided to face the orbiting scroll member across the back-pressure chamber forming member. Therefore, the orbiting bearing can be provided on the coupling member and need not be provided on the back of the orbiting scroll member. Accordingly, the back-pressure chamber provided between the back of the orbiting scroll member and the back-pressure chamber forming member can be designed freely independently of the orbiting bearing. Thus, the pressure-receiving area of the back-pressure chamber can be increased easily without increasing the overall configuration of the compressor or the like. In addition, because the back-pressure chamber can be formed into a circular configuration, for example, it can be sealed with a single seal member. Accordingly, reliability can be improved in comparison to a structure using two seal members.

In addition, according to the foregoing embodiment, a pressure-receiving member is provided at the back of the end plate of the orbiting scroll member at a distance from the end plate. Therefore, cooling air can be passed between the end plate of the orbiting scroll member and the pressure-receiving member. Consequently, even when the orbiting scroll member is heated by compression heat from the compression chambers, the orbiting scroll member can be cooled by using cooling air, and hence the compression efficiency can be increased.

In addition, according to the foregoing embodiment, the rotation preventing mechanism is provided between the coupling member and the casing. Therefore, the bearings of the auxiliary crank mechanisms can be disposed at the axially rear side of the wrap portion of the orbiting scroll member. Consequently, the compressor or the like can be reduced in size in the diametrical direction in comparison to a structure in which the rotation preventing mechanism is provided between the orbiting scroll member and the fixed scroll member.

In addition, according to the foregoing embodiment, a seal member for hermetically sealing the back-pressure chamber is provided between the back of the orbiting scroll member and the back-pressure chamber forming member. Therefore, the back-pressure chamber can be sealed by using a single seal member that surrounds the back-pressure chamber. Accordingly, reliability can be improved in comparison to a structure using two seal members.

In addition, according to the foregoing embodiment, a connecting member that connects together the orbiting scroll body and the pressure-receiving member is provided, and the connecting member is provided with a back-pressure inlet bore that communicates between the compression chambers and the back-pressure chamber. Accordingly, the orbiting scroll body and the pressure-receiving member can be secured to each other through the connecting member.

Although only some exemplary embodiments of this invention have been described in detail above, those skilled in the art will readily appreciate that many modifications are possible in the exemplary embodiments without materially departing from the novel teaching and advantages of this invention. Accordingly, all such modifications are intended to be included within the scope of this invention.

The present application claims priority under 35 U.S.C. section 119 to Japanese Patent Application No. 2006-296565, filed on Oct. 31, 2006.

The entire disclosure of Japanese Patent Application No. 2006-296565 filed on Oct. 31, 2006 including specification, claims, drawings and summary is incorporated herein by reference in its entirety.

What is claimed is:

1. A scroll fluid machine comprising:

a casing;

a fixed scroll member provided to said casing, said fixed scroll member having an end plate and a spiral wrap portion standing on a surface of said end plate;

a rotating shaft supported by said casing and driven to rotate by a drive source;

an orbiting scroll member provided to face said fixed scroll member, said orbiting scroll member having an end plate and a spiral wrap portion standing on a surface of said end plate so as to overlap the wrap portion of said fixed scroll member to define a plurality of compression chambers therebetween;

a back-pressure chamber forming member integrally provided with said casing at a back of said orbiting scroll member to form a back-pressure chamber between itself and the back of said orbiting scroll member said back-pressure chamber being in communication with said compression chambers;

a coupling member integrally provided with said orbiting scroll member with said back-pressure chamber forming member interposed therebetween, said coupling member being coupled to said rotating shaft through an orbiting bearing; and a rotation preventing mechanism that prevents said orbiting scroll member and coupling member from rotating around their axis.

2. The scroll fluid machine of claim 1, wherein said orbiting scroll member has a pressure-receiving member at a back of the end plate of said orbiting scroll member at a distance from said end plate.

3. The scroll fluid machine of claim 2, wherein said pressure-receiving member is provided between said orbiting scroll member and said back-pressure chamber forming member, and said back-pressure chamber is defined between said pressure-receiving member and said back-pressure chamber forming member.

4. The scroll fluid machine of claim 3, wherein said orbiting scroll member has an orbiting scroll body and said pressure-receiving member provided at a back of said orbiting scroll body, said orbiting scroll body and said pressure-receiving member being connected to each other through a connecting member, said connecting member being provided with a back-pressure inlet bore that communicates between said compression chambers and said back-pressure chamber.

5. The scroll fluid machine of claim 4, wherein said pressure-receiving member is provided on a back thereof with a recess circularly recessed over substantially an entire area thereof, and a back-pressure plate is fitted in said recess, said back-pressure chamber being formed at a back of said back-pressure plate, so that said pressure-receiving member receives a pressure in said back-pressure chamber through said back-pressure plate to press a whole of said orbiting scroll member toward said fixed scroll member.

6. The scroll fluid machine of claim 5, wherein said back-pressure chamber forming member has a mounting tube portion secured at one axial end thereof to an opening end of said casing at one end thereof and a substantially disk-shaped bottom plate portion located at the other axial end of said mounting tube portion to form a bottom surface, said bottom plate portion being provided with a circular compressed air storing portion recessed rearward of said bottom plate portion and closed at a rear end thereof, said back-pressure chamber being defined by said compressed air storing portion.

7. The scroll fluid machine of claim 6, wherein said bottom plate portion of said back-pressure chamber forming member is provided at an outer peripheral portion thereof with an annular seal fitting groove at a position facing said back-pressure plate, and an annular back-pressure seal member is fitted in said seal fitting groove.

8. The scroll fluid machine of claim 5, wherein said connecting member extends through said back-pressure plate and said pressure-receiving member and is threaded to the back of said orbiting scroll member, said connecting member having said back-pressure inlet bore axially extending therethrough, said back-pressure inlet bore opening at one end thereof in said back-pressure chamber and communicating at the other end thereof with said compression chambers through a through-hole extending through said end plate of said orbiting scroll member, so that said connecting member introduces compressed air in said compression chambers into said back-pressure chamber.

9. The scroll fluid machine of claim 2, wherein said rotation preventing mechanism is provided between said coupling member and said casing.

10. The scroll fluid machine of claim 2, wherein a seal member is provided between the back of said orbiting scroll member and said back-pressure chamber forming member to hermetically seal said back-pressure chamber.

11. The scroll fluid machine of claim 2, wherein said orbiting scroll member has an orbiting scroll body and said pressure-receiving member provided at a back of said orbiting scroll body, said orbiting scroll body and said pressure-receiving member being connected to each other through a connecting member, said connecting member being provided with a back-pressure inlet bore that communicates between said compression chambers and said back-pressure chamber.

12. The scroll fluid machine of claim 1, wherein said rotation preventing mechanism is provided between said coupling member and said casing.

13. The scroll fluid machine of claim 12, wherein said rotation preventing mechanism has a bearing housed in a bearing housing portion of said casing, a bearing housed in a bearing housing portion of said coupling member, and a crank member rotatably supported by said bearings.

14. The scroll fluid machine of claim 12, wherein a seal member is provided between the back of said orbiting scroll member and said back-pressure chamber forming member to hermetically seal said back-pressure chamber.

15. The scroll fluid machine of claim 12, wherein said orbiting scroll member has an orbiting scroll body and said pressure-receiving member provided at a back of said orbiting scroll body, said orbiting scroll body and said pressure-receiving member being connected to each other through a connecting member, said connecting member being provided with a back-pressure inlet bore that communicates between said compression chambers and said back-pressure chamber.

16. The scroll fluid machine of claim 1, wherein a seal member is provided between-the back of said orbiting scroll member and said back-pressure chamber forming member to hermetically seal said back-pressure chamber.

17. The scroll fluid machine of claim 16, wherein said orbiting scroll member has an orbiting scroll body and said pressure-receiving member provided at a back of said orbiting scroll body, said orbiting scroll body and said pressure-receiving member being connected to each other through a connecting member, said connecting member being provided with a back-pressure inlet bore that communicates between said compression chambers and said back-pressure chamber.

18. The scroll fluid machine of claim 1, wherein said coupling member has a tubular boss portion integrally formed at a center of a back thereof, a crank portion of said rotating shaft being rotatably fitted in said boss portion through an orbiting bearing.

* * * * *